United States Patent [19]

Warkentin

[11] 4,051,645

[45] Oct. 4, 1977

[54] COMESTIBLE PACKAGING APPARATUS

[76] Inventor: Aaron James Warkentin, 13551 View Drive, Orange Cove, Calif. 93636

[21] Appl. No.: 735,155

[22] Filed: Oct. 26, 1976

[51] Int. Cl.[2] ..... B65B 5/06

[52] U.S. Cl. ..... 53/248

[58] Field of Search ..... 53/248

[56] References Cited

U.S. PATENT DOCUMENTS

| | | | |
|---|---|---|---|
| 3,550,347 | 12/1970 | Coates | 53/248 X |
| 3,643,400 | 2/1972 | Barbet | 53/248 |
| 3,656,272 | 4/1972 | Sheetz | 53/248 X |

*Primary Examiner*—Travis S. McGehee
*Attorney, Agent, or Firm*—Lyon & Lyon

[57] ABSTRACT

Apples are packaged by introducing them in a water bath in which they float upwardly into an open bottom porous cage. After the cage is filled with apples it is moved laterally in the water bath to an apple loading zone for packaging in a wooden bin. The wooden bin is initially placed at such zone below the apple filled cage. The bin and cage are then raised out of the water to an elevation between a bin feed conveyor and a bin discharge conveyor. When and as the bin is being raised upwardly through the water the apples from the cage fall into the bin and once such apple filled bin reaches the above mentioned elevation an empty bin on the feed conveyor is moved to dislodge the apple-filled bin onto the discharge conveyor with the empty bin then remaining on the elevator and being subsequently moved downwardly through the water to a position below expectant arrival of another apple-filled cage. The apparatus to a certain extent is duplicated in that there are two apple receiving stations and correspondingly two open bottom cage bottom cages and while one cage is being filled with apples floating up through its open bottom, the other cage may be raised and lowered at the apple packaging zone and for this latter purposes the two cages are movable horizontally from a corresponding apple receiving station to the apple loading zone and vice versa.

4 Claims, 6 Drawing Figures

10
10
10C
8
12E
12C
12
12A
20C
18C
20B
37H
15
35
14C
100
18D
54
37
35A
30
A
32
53
22
37G
18
11A
20
16
7
A
10A
13C
11C
20A
18B
18A
10B
11C
11
10
2
3
3
2

4
22C
53B 22G
53
37
37G
22D
18A
35D
32
14C
14C
18
18B
30
18
10B
20A
20B
20C
10A
W
A
22
10
35B
35
35A
53A
G
B
37R
4

37
22E
22C
53B
53B
53
37E
22H
54
37G
40B
37H
22G
37
22
40
40A
22D
22F
35D
14C
18
10C
18C
W
37D
37B
35C
35B
37
37
37A
35
35A
37C
B
10
G
37R

COMESTIBLE PACKAGING APPARATUS

The present invention relates specifically to the packaging of apples but in a broader sense is applicable to other comestibles which, like apples, float in water.

A specific object of the present invention is to provide an improved comestible packaging apparatus featured by the fact that essentially the entire operation of packaging is accomplished underwater.

Another object of the present invention is to provide improved apparatus of this character in which there is simultaneous continuity of action in that apples for subsequent packaging are being processed while a previously batch of apples is being packaged, all underwater.

A specific object of the present invention is to provide improved apparatus of this character in which comestibles are efficiently packaged while being subjected to gentle action underwater in a relatively short time of less than 1 minute.

Another specific object of the present invention is to provide apparatus of this character which is relatively simple, compact and inexpensive considering the functions and results achieved thereby.

Another specific object of the present invention is to provide apparatus of this character involving the use of an open-bottom porous cage into which apples may float and then filled moved laterally to a loading zone where there is a submerged box into which the batch of apples gravitate when and as the cage and box is elevated through the washing water to a level between a feed conveyor and a discharge conveyor at the same elevation.

The features of the present invention which are believed to be novel are set forth with particularity in the appended claims. This invention itself, both as to its organization and manner of operation, together with further objects and advantages thereof, may be best understood by reference to the following description taken in connection with the accompanying drawings in which:

Figure 1:
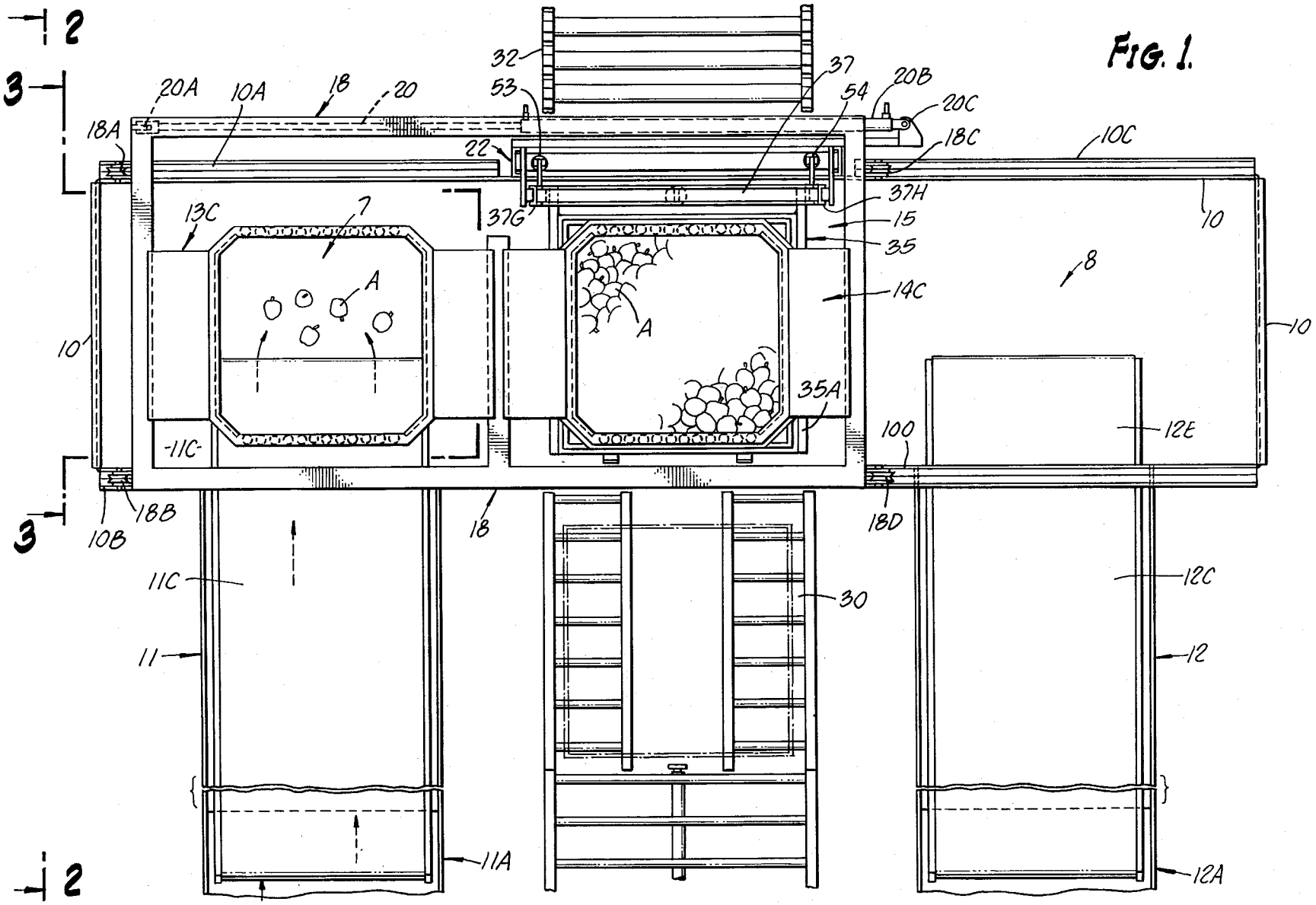
FIG. 1 is a top plane view of apparatus embodying the present invention.
Figure 2:
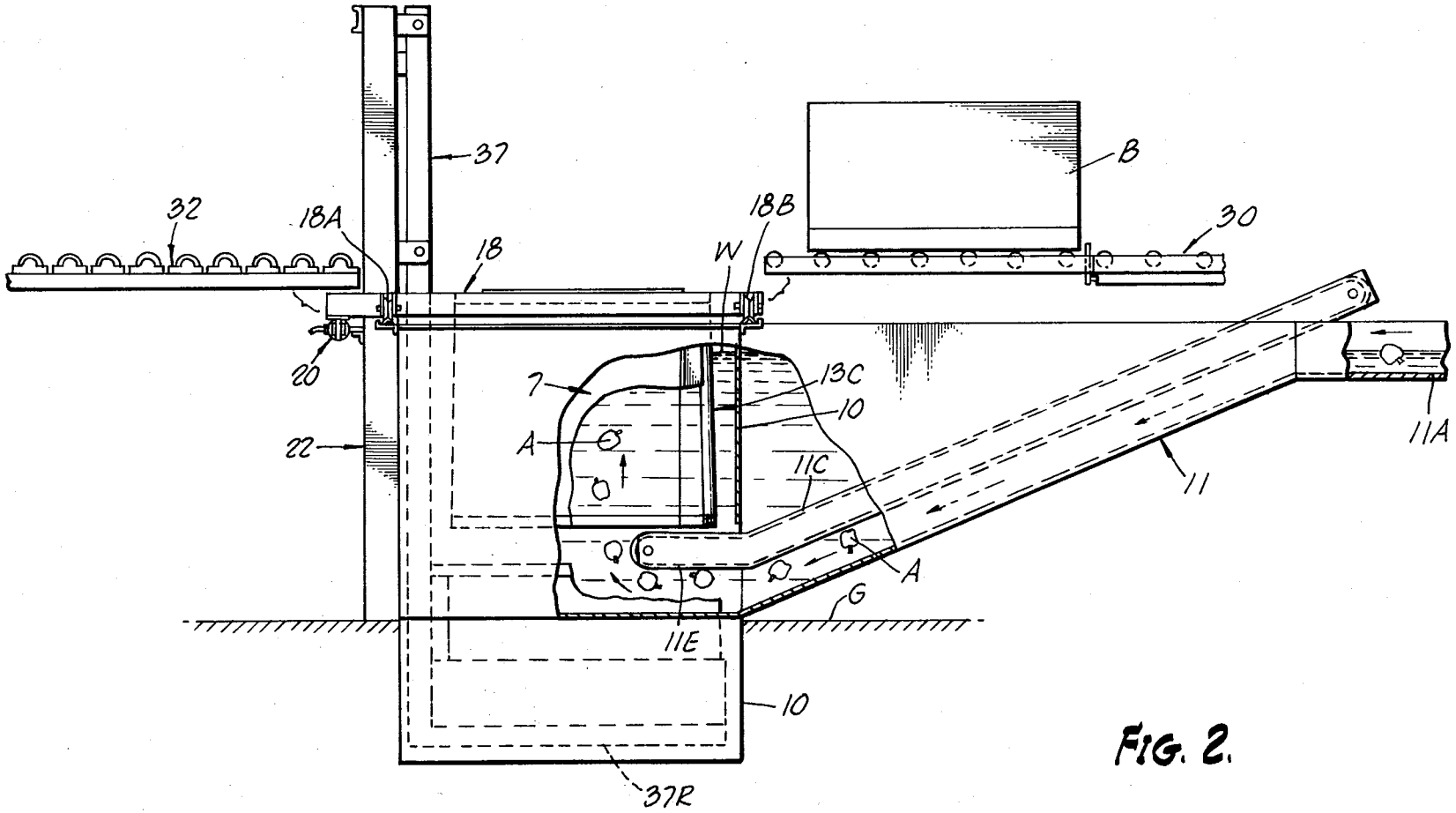
FIG. 2 is a view taken as indicated by the lines 2—2 in FIG. 1.

A metal tank 10 for containing water W is positioned partly below ground level G and is essentially rectangular and formed essentially of sheet metal as shown in FIGS. 1 and 2 with two communicating spaced laterally extending chute portions 11, 12 which, in turn, are in communication with a corresponding water flume 11A, 12A into which water W and apples A are introduced. Because apples float in water a descending conveyor 11C, 12C is disposed in a corresponding chute 11, 12 so as to transfer apples from the corresponding flume 11A, 12A to a corresponding apple receiving station 7, 8 region of the rectangular tank 10 when the corresponding conveyor 11C, 12C is operated as illustrated in FIG. 2.

One of the two conveyors 11C, 12C is operated when a corresponding one of the two transfer cages 13C, 14C is positioned immediately above the lower end of the corresponding conveyor 11C, 12C so that apples propelled downwardly by the moving belt of conveyor 11C as illustrated in FIG. 2 and losing contact with such belt at its lower generally horizontally extending end portion 11E may then float upwardly into and be confined within the corresponding transfer cage 13C.

Each transfer cage 13C, 14C is of identical construction and has an open bottom and an open top and porous sides and which after being thus filled with apples may be transfered laterally to a central apple loading zone 15 (FIG. 1).

FIG. 1 illustrates the transfer cage 14C in the central loading zone 15 with apples A therein, such transfer cage 14C having been previously positioned above the conveyor belt end portion 12E with the conveyor belt 12C then operating to transfer apples from flume 12A to a position below the transfer cage 14C to achieve such previous loading of transfer cage 14C as described above in relation to the other transfer cage 13C and its associated conveyor belt 11C in FIG. 2.

For these purposes the transfer cages 13C and 14C may be moved horizontally within tank 10 to the common central loading zone 15 from their corresponding apple receiving stations 7, 8 (FIG. 1). To achieve such horizonal movement and for other purposes the two transfer cages 13C, 14C rest in a seated condition within a common generally rectangular carrier frame 18 which has four rollers 18A, 18B, 18C, 18D (FIG. 1) riding on corresponding rail portions 10A, 10B, 10C, 10D formed on the upper portion of the rectangular water tank 10. This frame 18 with the transfer cages 13C, 14C resting therein may thus be shifted horizonally on the tank rails 10A-10D and this movement may be accomplished using a hydraulic ram 20 (FIG. 3) which has its piston portion 20A attached to frame 18 and its cylinder portion 20B attached at 20C to an extension of stationary structure 22.

Thus operation of the hydraulic ram 20 results in movement of transfer cage 13C from apple collecting station 7 (FIG. 1) to apple loading zone 15 and in simultaneous movement of transfer cage 14C from zone 15 to station 8 and vice versa upon repeated operation of ram 20.

When at zone 15 either transfer cage 13C or 14C, depending upon which one is there at that time, may be raised from its carrier 18 to effect a transfer of apples therein into an apple bin or container B which may be of wood and which is fed in empty condition towards zone 15 or bin feed conveyor 30 and thereafter moved away in apple loaded condition on bin discharge conveyor 32.

Figure 3:
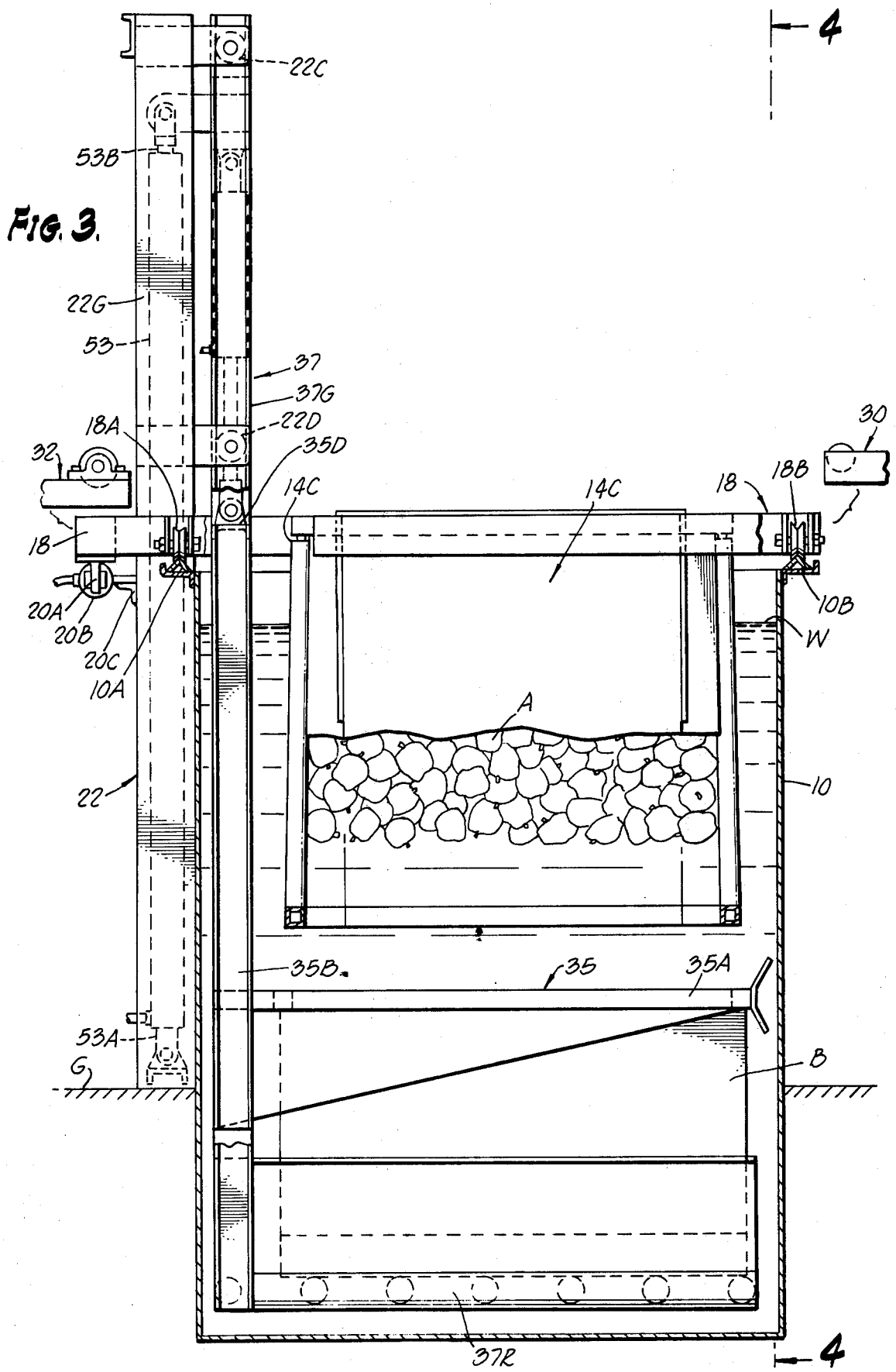
FIG. 3 is a view taken as indicated by the lines 3—3 in FIG. 1.
Figure 5:
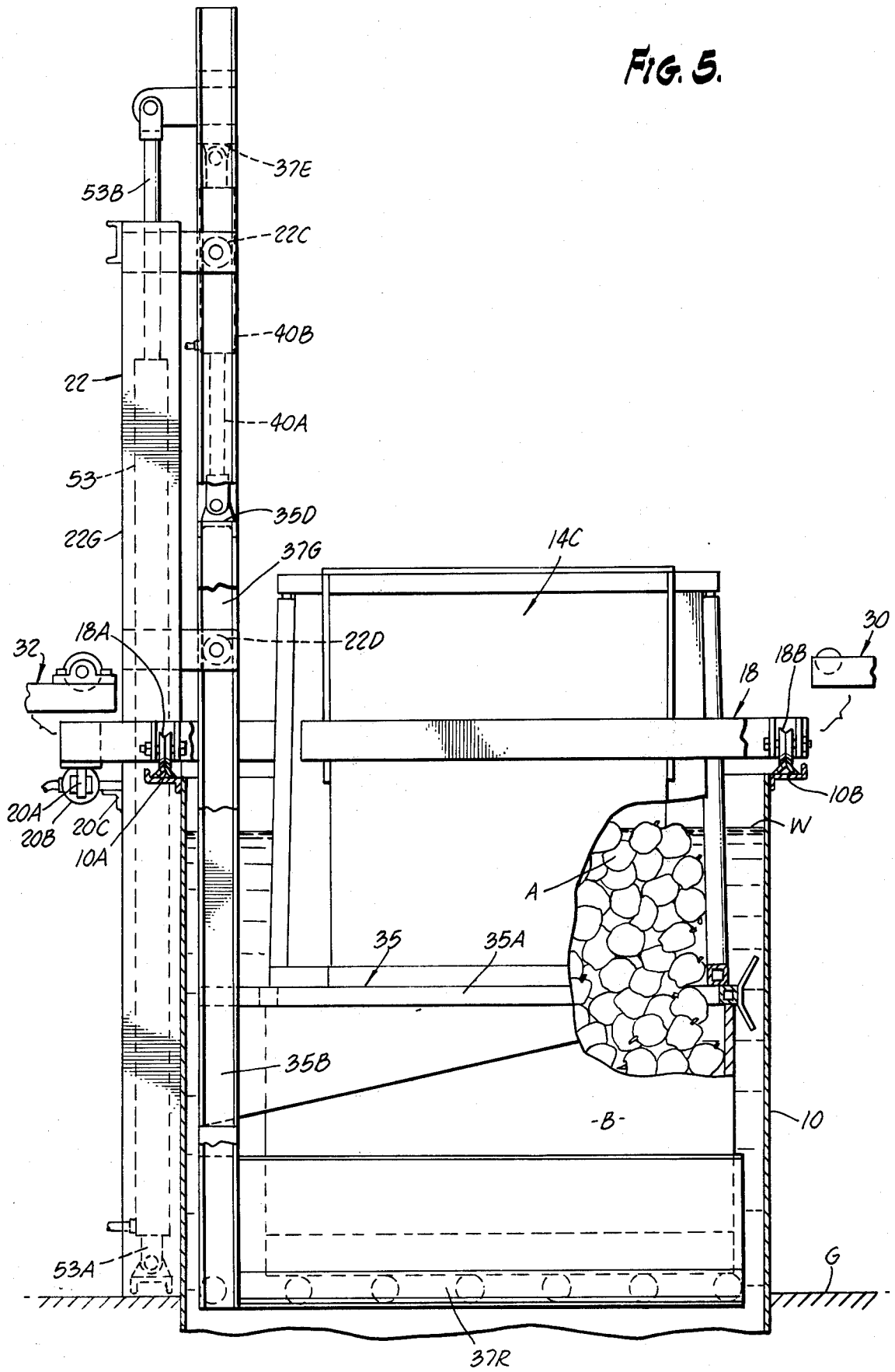
FIG. 5 is a view corresponding to FIG. 3 but with the Collar plane partially raised.
Figure 6:
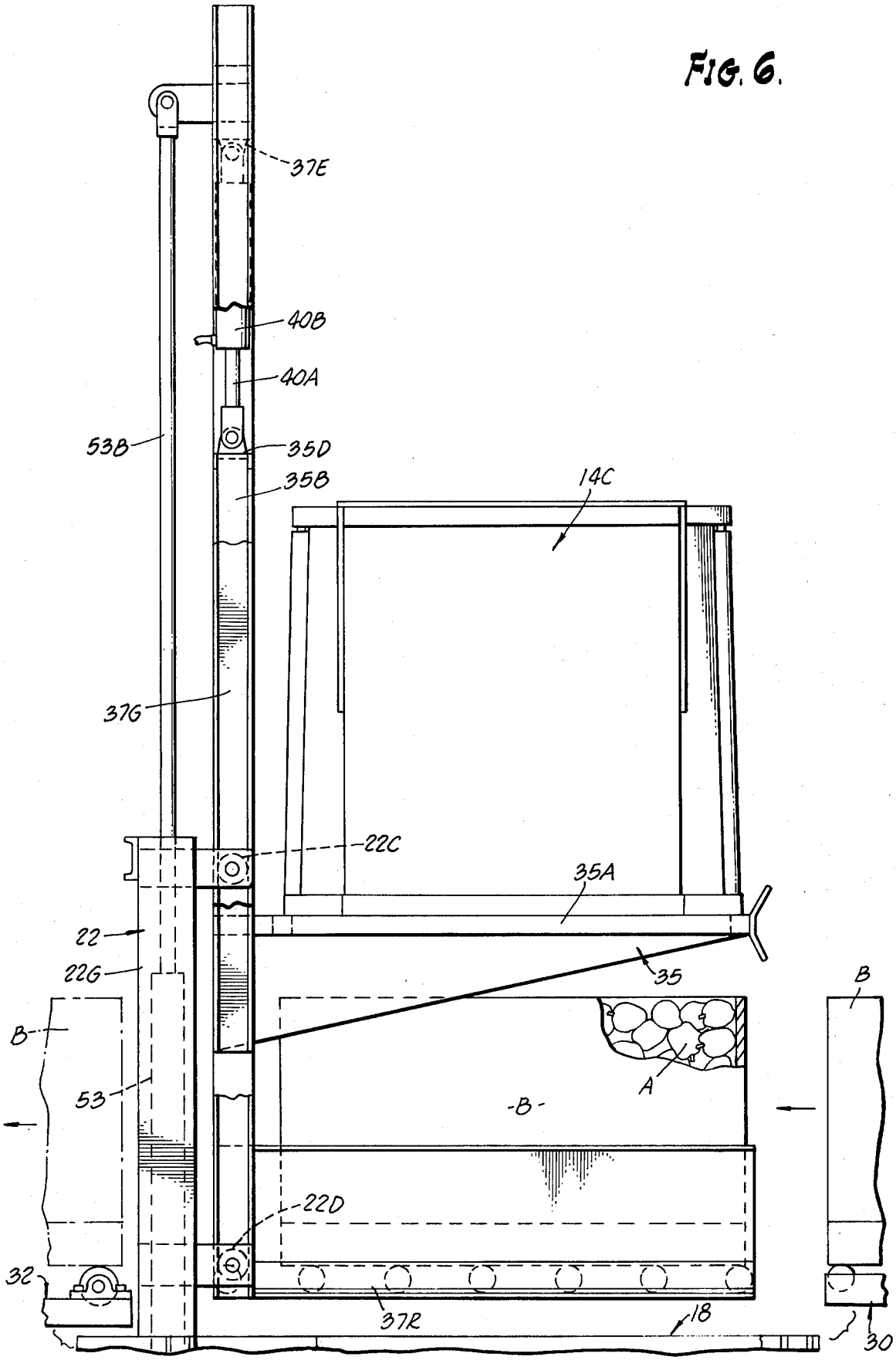
FIG. 6 is another view corresponding to FIG. 3 with the Collar frame fully raised and also the elevator frame fully raised.

The manner in which this transfer of apples from cage 14C to a bin B is effected is illustrated best in FIGS. 3, 5 and 6 which illustrate successive conditions in that order.

Initially a bin or apple container B is positioned below cage 14C as will be described later, such wooden bin B being of wood and being prevented from floating upwardly in FIGS. 3 and 4 by a vertically movable collar frame 35 which has a cantilever portion 35A engageable with the top edge of bin B and two vertical portions 35B and 35C attached thereto, such vertical portions 35B, 35C being interconnected at their upper ends by cross member 35D and cooperating with spaced guide members 37A, 37B and 37C, 37D respectively on an outer elevator frame 37 such that the collar frame 35 may be guided in its vertical sliding movement within the outer elevator frame 37.

This elevator frame 37 is, in turn, slidably mounted in the outer stationary structure 22 as described later. The collar frame 35 has its cross member 35D (FIG. 4) attached to the piston portion 40A of ram 40 which has its cylinder portion 40B connected to the horizonal cross member 37E of elevator frame 37. Thus operation of ram 40 results of movement of collar frame 35 in elevator frame 37 for purposes described later.

The elevator frame 37 is generally rectangular and includes two side rails 37G, 37H which cooperate with pairs of guide rollers 22C, 22D and 22E, 22F respectively on stationary vertical frame members 22G, 22H which are a part of structure 22. The elevator frame 37 is moved within stationary frame 22 using a pair of rams 53, 54 (FIGS. 1 and 4) which as illustrated in relation to ram 53 has its cylinder portion 53A (FIG. 5) stationarily attached to stationary frame or structure 22 and its piston portion 53B attached to the elevator frame 37.

Operation of the twin rams 53, 54 thus results in movement of the elevator frame 37 which extends below the bin B and has a base portion 37R comprising a series of conveyor rollers upon which the bin B may rest.

Initially the rams 53, 54 are operated to achieve the condition shown in FIG. 5 where raising of the elevator frame 37 results also in joint raising of the collar frame 35 which initially engages the lower portion of the open bottom cage 14C and then causes the cage 14C to be raised from its seat on carrier 18 to thereby effect a partial transfer of apples A from cage 14C into bin B as seen in FIG. 5.

The twin rams 53, 54 continue to operate beyond the position illustrated in FIG. 5 to their most extended condition wherein the conveyor rollers 37R on elevator frame 37 are at the same level, as shown in FIG. 6, with the elevation of bin feed rollers or conveyor 30 and also the same elevation as the bin discharge rollers or conveyor 32. When that condition is achieved the collar frame ram 40A, 40B is independently moved upwardly by operating ram 40 operated to raise the collar frame 35 within the elevator frame 37 to achieve the condition shown in FIG. 6 wherein the collar frame 35 is sufficiently elevated to allow the apple filled bin B to be pushed to the left onto the discharge conveyor 32 by a new empty bin which is moved from the bin feed conveyor 30 to the conveyor platform 37R of elevator frame 37.

Figure 4:
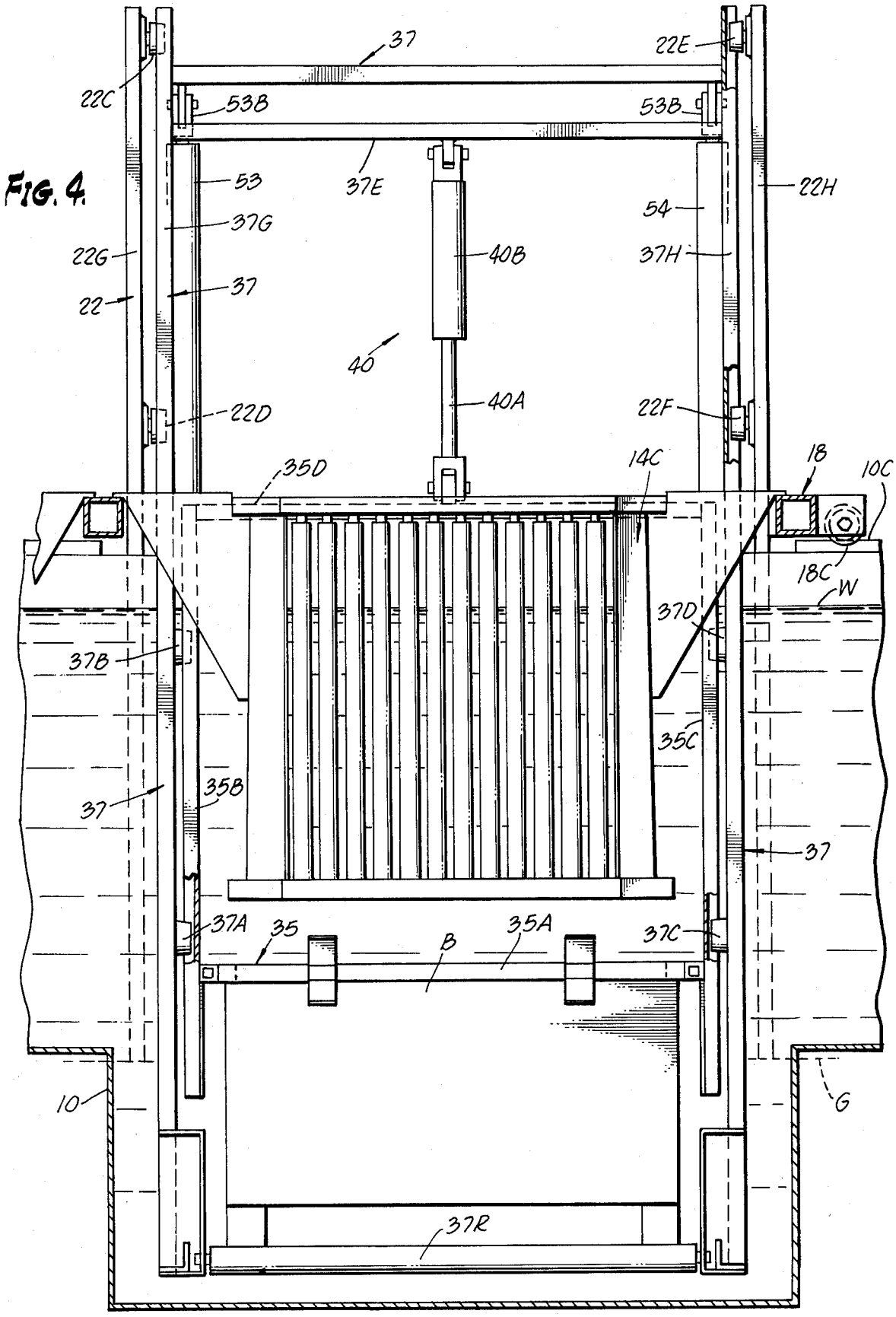
FIG. 4 is a view taken as indicated by the lines 4—4 in FIG. 3.

After such transfer the collar frame 35 is lowered by operating ram 40 and the elevator frame 37 is lowered by operating the twin rams 53, 54 until the empty bin is in the position and condition shown in FIGS. 3 and 4. In the meantime, apples have been loaded into cage 13C at apple loading station 7 in a manner described previously.

The cage 13C with the apples therein is then shifted to the loading zone 15 simultaneously with movement of the cage 14C to loading station 8 in the same carrier 18. The apples at zone 15 are then loaded into a bin B as explained simultaneously with loading of apples in cage 14C at the loading station 8 and with the conveyor 12 in operation.

Thus apples are in effect continuously loaded into wooden bins. The tank may be provided with overflow and/or discharge means and pump means to maintain a continuous flow of washing water.

While the invention has been described in relation to apples it is apparent that the invention may be used for packaging other comestibles which float in water.

While the particular embodiments of the present invention has been shown and described, it will be obvious to those skilled in the art that changes and modifications may be made without departing from the invention in its broader aspects and, therefore, the aim in the appended claims is to cover all changes and modifications as fall within the true spirit and scope of this invention.

What is claimed is:

1. In a system of the character described for packaging comestibles in a container, the combination comprising a first comestible receiving station, a second comestible receiving station, a comestible loading zone between said receiving stations, a first and a second open-bottom cage, a horizonally movable carrier for shifting one of said cages from one of said stations to said loading zone and the other one of said cages from said loading zone to the other of said stations and vice versa, means at each of said station for loading comestibles into a corresponding one of said cages, said cages being porous and having an open bottom and each of said stations being underwater with said loading means functioning to introduce the comestibles into the water below a corresponding cage such that the comestibles may float upwardly into the cage, means at the loading zone for positioning a container below the expected arrival point of a comestible filled cage, means at said zone for elevating said container and said cage simultaneously out of the water such that the comestibles gravitate into the container, a container feed conveyor and a container discharge conveyor, said elevated means functioning to elevate the comestible filled container to an elevation which is substantially the same as the elevation of said feed and discharge conveyors.

2. In a system of the character described for packaging comestibles in a container, the combination comprising means defining a water bath, an open bottom porous cage, means for moving said cage in said water bath from a comestible receiving station to a comestible loading zone, means at said receiving station for introducing comestibles into said water bath below said cage such that the comestibles may float upwardly into the cage, means for laterally moving a comestible filled cage from said receiving zone to said loading zone, means at said loading zone for introducing a container into said water bath at a sufficiently low elevation in said water bath such that a comestible filled cage may be positioned above said container, means for elevating said container and said cage as a unit out of the water bath so that the comestibles may gravitate from said cage into said chamber.

3. In a system of the character described and for packaging comestibles in a container, the combination comprising, means defining a water bath for comestibles to be packaged, an open bottom porous cage in said water bath, means for shifting said cage in said water bath from a comestible receiving station to a comestible loading zone and vice versa, means at said comestible receiving station for introducing comestibles into said water bath at a region below said cage so that the comestibles may float upwardly into the cage to fill the same, means for moving the filled cage from said receiving station to said loading zone through said water bath, means for introducing a container into said water bath at said loading zone and at a location below a filled cage at the loading zone, means for elevating said container and said filled cage upwardly out of the water bath such that the comestibles in said cage gravitate into said container, and means for moving said cage relative to said container so that said container may be moved laterally from the elevating means.

4. In a system of the character described for packaging comestibles in a container, the combination comprising, means defining a water bath, container elevating means for moving and positioning a container thereon from a first position above said water bath to a submerged position in said water bath, said elevating means incorporating means movable relative thereto for engaging said container to prevent said container from being buoyant in the water bath, an open bottom porous cage for confining comestibles in said water bath, means for filling said cage with comestibles and for moving the filled cage to a position above the submerged position of said container, and means for raising said elevating means to elevate said container and said cage to said first position above the water bath whereby the comestibles gravitate out of the open bottom cage into said container.

* * * * *

UNITED STATES PATENT AND TRADEMARK OFFICE

CERTIFICATE OF CORRECTION

PATENT NO. : 4,051,645

DATED : October 4, 1977

INVENTOR(S) : Aaron James Warkentin

It is certified that error appears in the above-identified patent and that said Letters Patent are hereby corrected as shown below:

Abstract, 2nd col. line 15, delete "bottom cage" (second occurrence).

Abstract, 2nd col. line 18, change "purposes" to read --purpose--.

Col. 1, line 29, after "then" insert --when--.

Col. 1, line 43, change "plane" to read --plan--.

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*